United States Patent [19]

Pettersson

[11] 4,023,882

[45] May 17, 1977

[54] ELECTRICAL CONNECTOR DEVICE SECURABLE TO METAL MEMBER

[76] Inventor: Börge Hugo Pettersson, Ekringen 17, S-582 69 Linkoping, Sweden

[22] Filed: May 10, 1976

[21] Appl. No.: 685,122

Related U.S. Application Data

[63] Continuation of Ser. No. 569,208, April 18, 1975, abandoned.

[30] Foreign Application Priority Data

Apr. 25, 1974 Sweden ..... 7405545

[52] U.S. Cl. ..... 339/96

[51] Int. Cl.² ..... H01R 9/08

[58] Field of Search ..... 339/94–99

[56] References Cited

UNITED STATES PATENTS

| | | | |
|---|---|---|---|
| 3,588,787 | 6/1971 | Kindell et al. | 339/95 A |
| 3,784,959 | 1/1974 | Horton | 339/96 |
| 3,853,385 | 12/1974 | Palazzetti | 339/96 |

FOREIGN PATENTS OR APPLICATIONS

| | | | |
|---|---|---|---|
| 1,024,525 | 3/1966 | United Kingdom | 339/95 A |
| 1,047,764 | 11/1966 | United Kingdom | 339/95 A |

*Primary Examiner*—Joseph H. McGlynn
*Attorney, Agent, or Firm*—Ira Milton Jones & Associates

[57] ABSTRACT

An electrical connector device comprises a disc-like connector element having a hole therethrough. From a face thereof substantially hard contact means projects outwardly, in the form of an annular ridge which tapers outwardly to a sharp or rounded edge and which is concentric to the hole and radially spaced therefrom. An elastically deformable sealing element overlies said face of the connector element and, in the unused device, embeds the contact means. Tightening of a screw through the hole, to secure the device to an object member, forces the contact means through the sealing element and partway into the object member. The annular electrical connection thus formed is durably sealed by the compressed sealing member.

9 Claims, 11 Drawing Figures

Fig. 7
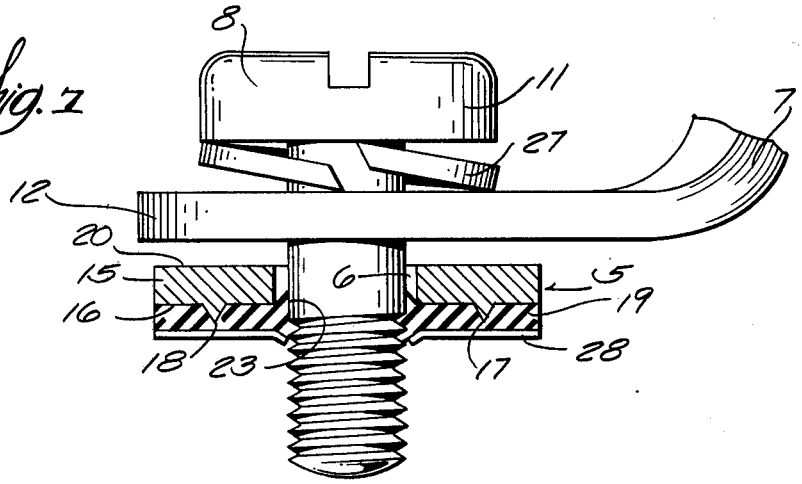
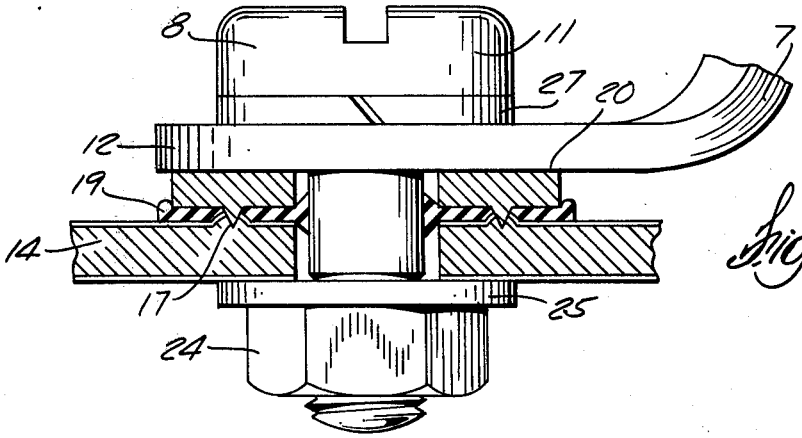
Fig. 8
Fig. 9
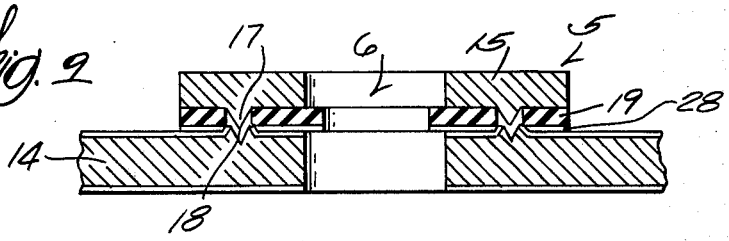

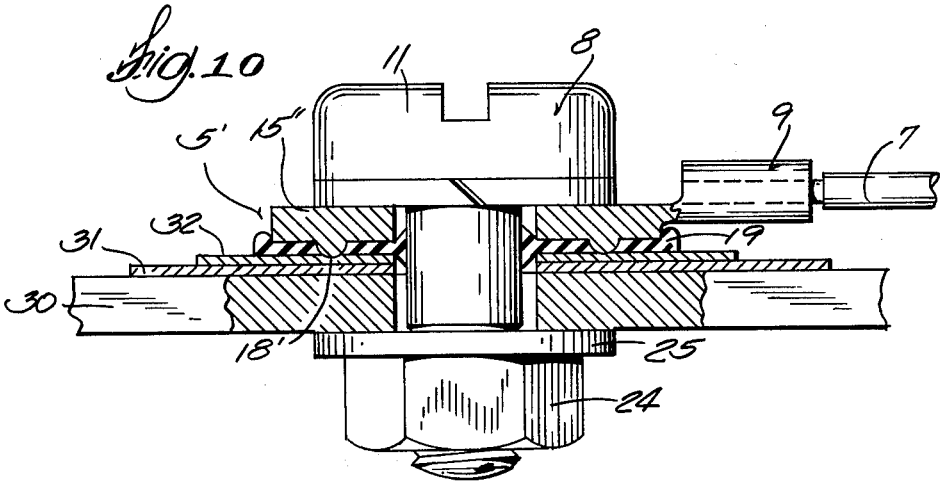
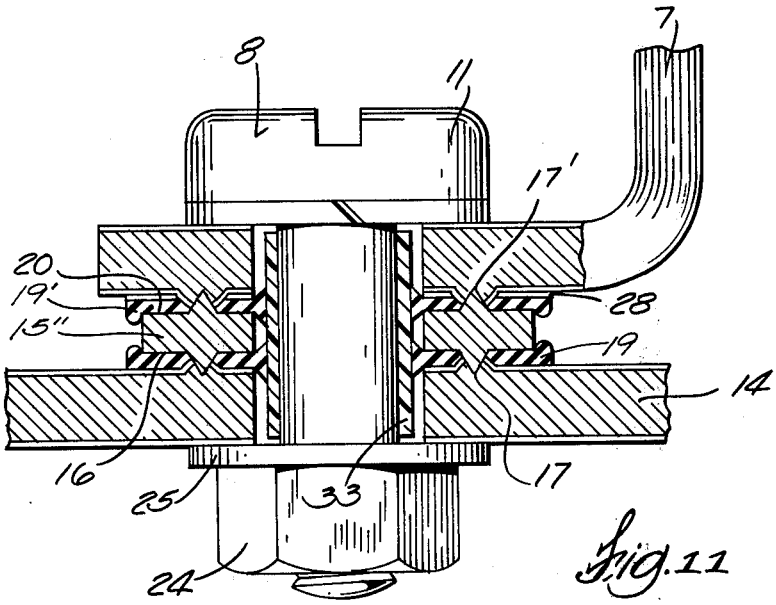
Fig. 11

ELECTRICAL CONNECTOR DEVICE SECURABLE TO METAL MEMBER

This application is a continuation of my copending application Ser. No. 569,208, filed Apr. 18, 1975, now abandoned.

This invention relates to electrical connectors, and is more particularly concerned with a device for electrically and mechanically connecting an electrical conductor and a more or less flat surface portion of an object member, which device has a contact portion that partially penetrates the metal of the object member to make good contact therewith in an electrical connection zone of limited extent, and has means providing a durable seal around the connection zone to prevent corrosive liquids and gases from coming into contact with the engaged metal portions that form the electrical connection.

Electrical connector devices of the general character to which this invention relates are useful in a wide variety of applications. In each case, an electrical conductor — which may be a wire, a metal strap, or a metal structural member or part — is connected by means of the device to a structural member or part that is herein referred to as the object member. In general, the object member is made of metal and has a substantially flat surface portion to which the connector device can be secured by means of a screw or the like that is received in a hole in the object member.

As examples of uses of such a connector device, it can provide a grounding connection between a wire or a conductive strap and a metal structural member such as a vehicle chassis or machine frame; or it can provide an electrical and mechanical connection between a pair of metal structural members which have substantially differing galvanic potentials, as for example copper and aluminum; or it can be used to connect a conductor to a conductive terminal area on a printed circuit board or the like.

In many applications in which such a connector device is used, there is an electrically insulating coating on the object member. The coating may be merely a thin film of oxide that forms naturally on the surface of the object member, but often it comprises a specially applied coating (as of lacquer or the like) that serves both to protect the object member from corrosion and to insulate it electrically. With many types of prior connectors a special cleaning operation had to be performed upon the surface of the object member, in the area where the connector was to be installed. However, a connector device of the general type here under consideration does not require performance of any operation for local removal of coating on the object member because the connector device has a contact portion with a more or less sharp edge, and it is so installed that this edge is forced into penetrating engagement with the metal of the object member, through any coating that may be present on its surface.

With all prior connector devices that might be subject to corrosion, it was customary, after installation, to apply a protective sealer coating of lacquer or the like on and around the connector device and its securement means. This sealer was applied in such a manner as to penetrate as much as possible into the tiny space between the opposing surfaces of the connector device and the object member.

The need for applying the sealer coat of course entailed an additional operation that had to be performed during the assembly process, and the need for it was in itself a disadvantage of prior connector devices. However, it often happened that the sealer coat did not achieve the necessary penetration, coverage or adhesion, so that corrosive fluid could enter minute gaps of flaws in the sealer coat, and corrosion could develop even though the sealer was conscientiously applied. In this respect, it should be borne in mind that even the air can constitute a corrosive fluid, since atmospheric moisture can give rise to galvanic corrosion of contacting metal parts having substantially different galvanic potentials.

There is often a degree of relative movement between a connector device and an object member to which it is connected, and where a protective lacquer or similar sealer coat was applied after installation of the connector device, the sealer coat could be cracked by such relative motion, so that in such cases the parts could be exposed to corrosion notwithstanding flawless application of the sealer coat.

Most prior electrical connector devices of the general type here under consideration have been provided with a number of pointed serrations or teeth that were intended to penetrate any insulating coating on the object member and bite into the metal of that member to make good contact therewith. However, if the object member was subject to fatigue stress, the small, localized depressions in its metal that were created by the connector could act as so-called stress-raisers and lead to fracturing.

Having in mind these disadvantages of prior electrical connector devices, it is the general object of the present invention to provide an electrical connector of the character described that does not possess such disadvantages but, instead, affords a connecton between a conductor and an object member that is mechanically and electrically sound, does not require an insulation removal operation prior to its installation, does not require a sealing operation after it is installed in order to secure its corrosion resistance, and has no tendency to produce stress raisers in an object member to which it is attached.

In particular, it is an object of the invention to provide an electrical connector device that comprises edged, substantially hard contact means adapted to penetrate through an insulation coating on the surface of an object member and partway into the underlying metal of that member to make a good electrical connection therewith, and packing means for automatically providing a durable and secure gas-tight and liquid-tight seal around the connection thus established, which packing means also serves, in the unused connector device, to protect the contact means against mechanical damage.

Another specific object of this invention is to provide an electrical connector device comprising a rigid connector element having a substantially flat face, securement means for clampingly drawing the connector element in a direction to move its said face towards a surface of an object member, and substantially hard contact means projecting outwardly from said face of the connector element and adapted to make good electrical connection with the metal of an object member even when the same is covered with an insulating coating, wherein the contact means is so arranged that it does not tend to induce fatigue failure in an object member to which the device is secured but, instead, can actually afford a local increase in mechanical strength around a hole in the object member that accommodates the securement means.

Another object of this invention, particularly achieved in certain embodiments thereof, is to provide a device of the character described whereby a conductor can be electrically connected with an object member in such a manner as to provide for disassembly of the conductor and object member (as for repair or maintenance) without breaking the seal between the contacting parts of the connector device and the object member.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate several complete examples of embodiments of the invention constructed according to the best modes so far devised for the practical application of the principles thereof, and in which:

FIG. 7 is a view, partly in longitudinal section, partly in side elevation, of a connector device generally like that illustrated in FIGS. 1 and 3, shown in its relationship to an electrical conductor ad to securement means for attaching the device to an object member;

FIG. 8 is a view generally similar to FIG. 7 but showing the device installed on an object member;

FIG. 9 is a view generally similar to FIG. 8 but illustrating how the connector device can be secured to an object member by means of a bonding material so that a screw used for attachment of the device can be removed after installation;

FIG. 10 is a view generally similar to FIGS. 8 and 9 but showing a form of the connector device generally like that of FIGS. 2 and 4, in its securement to a printed circuit board; and FIG. 11 is a view generally similar to FIGS. 8–10 but showing a form of the device like that illustrated in FIG. 6, connected between two structural members.

Figure 1:
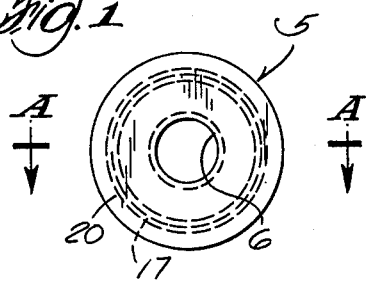
FIG. 1 is a plan view of an electrical connector device embodying the principles of the invention.

Referring now more particularly to the accompanying drawings, the numeral 5 designates generally the body of a connector device of this invention, which can have the general shape of a washer or a disc, with a hole 6 therethrough. The device also comprises securement means by which the body 5 can be fastened to an object member 14, which securement means can comprise a screw fastener 8, received in the hole 6. The device further comprises means by which a wire, cable or other electrical conductor 7 can be secured to its body. In the case of the device illustrated in FIGS. 2 and 10, the conductor securing means comprises a shoe 9 that projects radially from the body and is adapted to be crimped or clinched to a wire or the like. In other cases, the head 11 of the screw 8, in its cooperation with an eyelet terminal 12 or the like, provides the conductor securing means, the conductor 7 being connected to the terminal 12 in any conventional manner.

In general, the body 5 of the connector device comprises a rigid connector element 15 that has a substantially flat front face 16; substantially hard contact means 17 on said face of the connector element, projecting away from said face and defining an edge 18; and a packing or sealing element 19 of yieldingly deformable material.

Preferably the contact means 17 is formed integrally with the connector element 15, and as a rule the connector element 15 will be of substantially harder metal than the object member for which it is intended. In most cases the connector element and integral contact means can be made of carbon steel coated with a thin layer of cadmium or of stainless steel, but other metals may be used.

Figure 2:
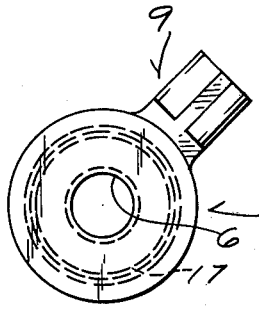
FIG. 2 is a view similar to FIG. 1 but showing a modified embodiment of the device.
Figure 3:
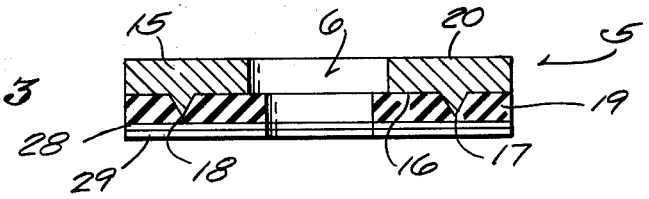
FIGS. 3–6 are sectional views which, although illustrating various embodiments of the invention, can all be regarded as taken on the plane of the ine A—A in FIG. 1.

As shown in FIGS. 1 and 3–9, the connector element is annular and washer-like, and the axis of the hole 6 through it is normal to its front face 16. As shown in FIGS. 2 and 10, the connector element 15′ can have the conductor securing shoe 9 formed integrally with it and projecting radially to one side of it, but in that case the connector element is otherwise similar to the annular connector elements shown in the other figures.

Figure 6:
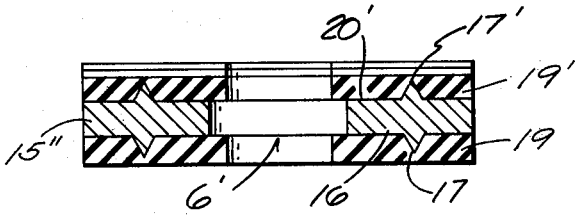

In most cases the connector element has a plain flat rear face 20; but as shown in FIGS. 6 and 11, contact means 17′ can project from the rear face of the connector element 15″, in addition to the contact means 17 projecting from its front face 16, so that the device can be used for electrically and mechanically connecting a pair of structural members.

Figure 4:
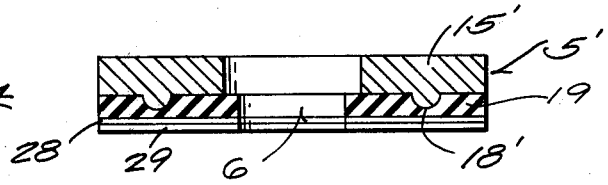
Figure 5:
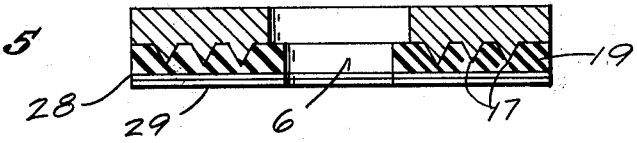

Preferably the contact means 17 comprises at least one annular ridge or land that is concentric to the axis of the hole 6 and is spaced radially outwardly from the edge of the hole. As illustrated in FIG. 5, the contact means can comprise a plurality of such lands, all concentric to the axis of the hole and radially spaced from its edge and from one another. In each instance the contact means tapers axially outwardly from the face 16 from which it projects, terminating at the edge 18. As illustrated in FIGS 3, 5–9 and 11, the taper of the contact means can be such that it is triangular in cross-section and its edge 18 is a sharp one; or, as shown in FIGS. 4 and 10, the taper can be more gradual and the edge 18′ can be a rounded one. The particular cross sectional shape is selected in accordance with the material of the object member for which the device is intended, the nature of any coating thaat may be on the surface of the object member, and the required area of metal-to-metal engagement in the zone of electrical connection. It is preferred that each annular land or ridge that comprises a contact means be of uniform cross section all around it, so that its edge 18 can make a line contact with a flat surface that opposes and is parallel to the face of the connector element from which the land projects.

The packing or sealing element 19 overlies substantially the whole of the front face 17 of the connector element, and if the rear face 20 of that element has contact means 17′, then another packing or sealing element 19′ overlies the rear face, as shown in FIGS. 6 and 11. Each sealing element is made of a yielding, elastically deformable material. A material particularly well suited for the purpose is polysulphide rubber. Specific examples of suitable materials are: Products Research & Chemical Corp., PR 1201 Q and Minnesota Mining & Mfg. Co., EC 1675 B/A. In the unused connector device the thickness of each sealing element is greater than the axial projection of its adjacent contact means, so that the sealing element embeds the contact means to preserve the same from mechanical damage prior to use of the connector. Preferably the sealing element has a snug frictional fit around the shank of the screw fastener 8 that is received in the hole 6 in the connector element; and thus, in the unused device, the sealing element frictionally holds the screw fastener assembled with the connector element. Preferably, the connector element and the sealing element are brought into engagement before the material of the sealing element has cured, so that the sealing element is bonded to the connector element, or, if assembled after curing of the sealing element, they can be bonded to one another with a suitable adhesive.

As may be seen from a comparison of FIGS. 7 and 8, the connector device of this invention can be installed on an object member 14 in which there is a hole 23 of a size to receive the screw fastener 8. As shown, the screw fastener is a bolt that cooperates with a nut 24. Preferably a metal washer 25 is interposed between the nut and its adjacent surface of the object member. As shown, there is also a lock washer 27 between the head of the screw fastener and the upper face of the connector element, to compensate for thermal expansion and contraction of the screw 8 and maintain a tight connection. It will be understood that the screw fastener could be a sheet metal screw receivable in a hole of appropriate size in the object member. However, in most cases it will preferably be a bolt and nut, as shown, and the washer 25 will have a diameter slightly larger than that of the largest contact means ring, to insure that the metal of the object member will be subjected only to compressive stress under opposing forces exerted upon it by the contact means and the washer 25.

When the connector device is installed on an object member and the screw fastener is tightened, the clamping force which the screw exerts through the connector element deforms the packing or sealing element 19, compressing it axially and expanding it radially. By reason of the compression of the sealing element, the contact means is caused to project through it and into engagement with the object member; and with continued tightening of the screw fastener, the contact means penetrates through the insulation coating on the object member and partway into the metal thereof, so that an uncorroded metal-to-metal electrical connection is established. Because the material of the sealing element was initially at radially opposite sides of the contact means, all around the same, the compressed material of the sealing element, which will have been forced into intimate engagement with the object member, will permanently and completely seal the zone of this connection. It is therefore unnecessary to apply any kind of sealer to or around the connector device of this invention after the same is installed. Notice that the sealing of the zone of contact takes place simultaneously with establishment of metal-to-metal contact between the contact means and the object member, so that there is no chance for corrosion to occur.

In some cases it may be desirable to be able to temporarily remove the screw fastener from the connecting device after it is installed on an object member, as when the conductor must be disassembled from the object member for a repair or maintenance operation. At such times, the seal around the contact zone should not be broken. On a device intended for such installations, the securement means comprises, in addition to the screw fastener 8, a layer 28 of a self-adhering cement or bonding material over the outer face of the sealing element. A suggested adhesive sutable for that purpose is Minnesota Mining & Mfg. Co. XA 4224. Until the device is used, the adhesive coating is protected by a sheet 29 of waxed paper or the like that is peeled off just prior to installation.

FIG. 9 shows the device attached to an object member by means of a layer of adhesive material, after removal of the screw that drew the connector element into clamping relationship with the object member. Due to elasticity of the sealing element, the contact means is out of contact with the object member upon removal of the screw; but when the screw is replaced and is again tightened, the contact means will of course re-enter the groove it previously made and good contact will be restored. Where the screw is to be removed, maintenance of the seal intact requires that the sealing element be bonded to the connector element.

FIG. 10 illustrates the device installed on an object member in the nature of a printed circuit board, comprising, as is conventional, a substrate 30 of relatively hard insulating material, a copper foil printed circuit 31 overlying one face of the substrate, and a layer of tin 32 overlying a portion of the printed circuit in a terminal zone. The contact means 17 of the connector device engages the layer of tin, and, in view of the softness of that material, the contact means has a rounded edge 18' so that it will sink partway into the tin without penetrating through it. The sealing element 19 in this case not only performs its important function of permanently sealing the zone of electrical connection against corrosion but serves the further important purpose of confining and retaining any small chips of tin that may be produced by installation of the connector device or by any subsequent relative movement between it and the object member, so that the electronic function of the printed circuit assembly can be performed without disturbance from such chips.

FIG. 11 illustrates a connector device generally similar to that of FIG. 6, with contact means 17, 17' on both faces 16, 20 of its connector element, and with a sealing element 19, 19' overlying each face and the contact means thereon, said connector device being employed to provide an electrical and mechanical connection between a pair of structural members that may have markedly different galvanic potentials. One of the structural members is designated as an object member 14 and the other as a conductor 7 carried by the object member, but these designations are obviously arbitrary and could be reversed. The connector device is shown as securely attached to the structural member 7 by means of an adhesive layer 28 so that the other structural member 14 can be disassembled from the connector device and the structural member 7. It will be understood that the structural member 14 has a galvanic potential substantially like that of the connector element 15' so that occasional disruptions of the seal provided by the sealing element 19 will not give rise to corrosion problems. If the two structural members have galvanic potentials substantially different from that of the connector element, as well as substantially different from one another, two identical connector devices of the type shown in FIG. 3 can be used to connect them, the two connector devices being arranged back-toback and each having its sealing element adhesively bonded to one of the structural members.

In the case of the connection illustrated in FIG. 11, the screw 8 that comprises a part of the securement means is surrounded by an electrically insulating tube 33, which cooperates with the insulating washer 25 to insulate other parts of the connector device from the structural members, so that the electrical connections exist only at the contact means and no galvanic currents can develop between the screw and the structural members.

It will be seen that when any of the connector devices of this invention is clampingly secured to an object member by tightening of the screw fastener 8, the contact means, in partially penetrating the metal of the object member, yieldingly displaces that metal to a certain extent and compresses it in the annular zone of electrical contact, all around the ring defined by the edge 18 on the contact means. The permanent annular zone of local stress thus created, radially spaced from the edge of the screw hole 23 in the object member, retards the occurrence of fatigue cracks in the neighborhood of that hole, in contrast to former connector devices with more or less pointed, tooth-like contact means that actually encouraged the formation of fatigue cracks.

From the foregoing description taken with the accompanying drawings it will be apparent that this invention provides a connector device that enables a good mechanical and electrical connection to be made between a conductor and an object member without the need for localized removal of any insulation coating that may be present on the object member and without danger of creating stress raisers in the object member by reason of the installation. More important, the invention provides a connector device whereby a secure and durable seal is automatically established around the zone of metal-to-metal contact by the act of installing the device and simultaneously with the establishment of such contact, so that there is no chance for corrosion to occur even as between connected members having substantially different galvanic potentials.

Those skilled in the art will appreciate that the invention can be embodied in forms other than as herein disclosed for purposes of illustration.

The invention is defined by the following claims:

I claim:

1. A device for providing a good and durable mechanical and electrical connection between an electrical conductor and an object member even though the object member may have an electrically insulating surface coating that is required to remain intact except in a limited zone of electrical connection, said device comprising:

A. a rigid connector element of electrically conductive material having a substantially flat surface that faces substantially in one direction;

B. means on a portion of said connector element other than its said surface for connecting an electrical conductor to it;

C. substantially hard electrically conductive contact means on said connector element, projecting a distance in said one direction from said surface thereof and tapering to an edge remote from said surface that is capable of penetrating a surface coating on an object member, said contact means being spaced from the edges of said surface of the connector element;

D. a sealing element of elastically deformable material 1. bonded to and overlying substantially the whole of said surface of the connector element,
2. having a substantially flat surface parallel to said surface of the connector element and spaced in said direction more than said distance therefrom, and
3. completely embedding said contact means; and E. force exerting and maintaining means engaging a portion of said connector element other than said surface thereof and comprising a part which is movable relative to the connector element, said force exerting and maintaining means being cooperable with an object member for compelling substantially translatory motion of the connector element in said one direction whereby the sealing element is compressed between the connector element and a surface portion of the object member while the contact means is forced through the sealing element and into penetrating engagement with said surface portion of the object member, and for confining the connector element in a position relative to the object member at which such engagement is maintained while the compressed sealing element cooperates with the connector element and the object member to maintain a seal all around the zone of such engagement.

2. The device of claim 1 wherein the connector element has a hole therethrough, the axis of which is normal to its said surface, further characterized by:

1. said contact means being ridge-like, annular, and concentric to said hole; and
2. said force exerting and maintaining means comprising a screw which extends through said hole and is receivable in a hole in the object member, said screw being snugly embraced by said sealing element.

3. The device of claim 2, further characterized by:

a coating of an adhesive material over said surface of the sealing element, for retaining said seal upon removal of the screw from the object member.

4. A device for providing a good and durable mechanical and electrical connection between an electrical conductor and an object member even though the object member may have an electrically insulating surface coating that is required to remain intact except in a limited zone of electrical connection, said device comprising:

A. a rigid electrically conductive connector element having a pair of opposite faces and through which there is a hole that has its axis transverse to said faces;

B. substantially hard electrically conductive contact means on one of said faces of the connector element defining an annular ridge that projects from said face, is substantially concentric to said hole, and is radially spaced from both the inner and the outer edges of said face, said contact means, in cross-section, being tapered to a sharp edge so as to make an annular line contact with a surface engaged thereby that is substantially parallel to said one face;

C. means for securing an electrical conductor to a portion of the connector element other than said one face thereof;

D. a fastening member than can extend through said hole and through a registering hole in an object member and by which a clamping force can be exerted and maintained upon the connector element whereby said one face thereof is urged towards the object member; and E. a sealing element of elastically deformable material overlying substantially the whole of said one face of the connector element and having a substantially flat surface parallel to said one face, said sealing element
   1. being thick enough, in the unused device, to completely embed said contact means,
   2. being bonded to said one face of the connector element across substantially the whole area thereof and to said contact means, and
   3. being penetrable by the contact means upon the application of clamping force to the connector element, to enable the contact means to bite into an adjacent surface of an object member and make good electrical contact therewith in an annular contact zone while the compressed sealing element cooperates with the connector element and the object member to provide a seal around said contact zone both radially inwardly and radially outwardly thereof.

5. A device whereby an electrical connection can be made to a metal object member that has a hole therein, a substantially flat surface around said hole, and an electrically insulating coating on said surface that must remain intact except at a limited zone of electrical contact adjacent to said hole, and whereby a seal can be maintained all around said hole and said zone of electrical contact to prevent leakage through the hole and galvanic corrosion at said zone, said device comprising:

A. a rigid connector element of electrically connecting material having
   1. a hole therethrough,
   2. a substantially flat surface surrounding said hole and normal to the axis thereof, said surface facing in one direction, and
   3. an annular ridge projecting in said direction from said surface and tapering in said direction to a sharp annular edge which lies substantially in a plane that is parallel to said surface and is spaced in said direction therefrom, said ridge being radially spaced from both said hole and the perimeter of said surface;

B. a screw member received in said hole in the connector element and receivable in a hole in an object member, for exerting a clamping force by which the connector element is urged in said direction towards a surface on the object member that surrounds the hole therein; and C. a sealing element of elastically deformable material overlying substantially the whole of said surface on the connector element, said sealing element
   1. snugly embracing said screw,
   2. being bonded to said surface and to said ridge, and
   3. in its unused condition completely embedding said ridge but being penetrable by said ridge when the sealing element is elastically deformed under axial compression between the connector element and the object member, to allow the ridge to bite into the metal of the object member.

6. A device for providing a good and durable mechanical and electrical connection between an electrical conductor and an object member even though the object member may have an electrically insulating surface coating that is required to remain intact except in a limited zone of electrical connection, and even though the conductor and the object member may have substantially differing galvanic potentials, said device comprising:

A. a rigid connector element of electrically conductive material having a sealing face that faces substantially in one direction;

B. means on a portion of said connector element other than its said sealing face for connecting an electrical conductor to it;

C. substantially hard electrically conductive contact means on said sealing face, projecting in said direction therefrom and tapering to an edge remote from said sealing face that is capable of penetrating a surface coating on an object member;

D. a sealing element of elastically deformable material embedding said contact means, said sealing element having an outer face configured in substantial correspondence with a surface portion of an object member and having an inner face which overlies and is bonded to portions of said sealing face of the connector element all around the contact means;

E. means for forcefully urging the connector element in said direction and in clamping relationship with an object member to compress the sealing element and force the contact means through the sealing element and into penetrating engagement with a surface portion of the object member, compression of the sealing element also establishing it in sealing relationship to the connector element and the object member all around the contact means; and F. a coating of an adhesive material over the outer face of the sealing element, for retaining said sealing relationship upon removal of said means for forcefully urging the connector element in said direction.

7. The device of claim 6 wherein said sealing face of the connector element is flat, and the connector element has a hole therethrough that has its axis normal to said sealing face of the connector element, further characterized by:

1. said contact means being ridge-like and annular, concentric to said hole and spaced radially therefrom; and
2. said means for forcefully urging the connector element into clamping relationship with an object member comprising a screw which extends through said hole and is receivable in a hole in an object member.

8. The device of claim 7 wherein said screw has a head that overlies an opposite face of the connector element and wherein said means for connecting an electrical conductor to the connecting element comprises a lug that is clampingly confined between the head of said screw and said opposite face of the connector element.

9. A device for providing a good electrical connection between an electrical conductor and an object member that has a hole therethrough and has a substantially flat electrically conducting surface adjacent to the hole, whereby such connection can be made even though said surface may have an insulation coating that is required to remain intact except in a limited zone of electrical connection, and whereby corrosion of the connected parts is effectively prevented even though they may have substantially different galvanic potentials, said device comprising:

A. a rigid, electrically conductive connector element having a hole therethrough and having a face normal to the axis of said hole and surrounding the same;

B. substantially hard electrically conductive contact means on said connector element projecting outwardly from said face thereof in spaced relation to said hole and to the periphery of said face and having a taper in the direction away from said one face to define an edge that can partway penetrate the metal of an object member;

C. means for securing an electrical conductor to a portion of the connector element other than said one face thereof;

D. a sealing element of elastically deformable material bonded to and overlying said face of the connector element, said sealing element embedding the contact means and being disposed both radially inwardly and radially outward thereof, said sealing element having a flat outer face that is substantially parallel to said face of the connector element;

E. fastening means for securing the device to an object member and for establishing a clamping force between the connector element and a surface of the object member that opposes said face of the connector element, such clamping force causing the contact means to be forced through the sealing element and into good electrically connecting engagement with the object member and causing the sealing element to be compressed into sealing relationship with the object member all around the zone of such engagement, said fastening means comprising a screw that can extend through said hole in the connector element and the hole in the object member; and F. a coating of an adhesive bonding material over said outer face of the sealing element, whereby the device is retained in place on an object member when the screw is withdrawn so that the seal between the object member and the connector element is not disrupted.

* * * * *

UNITED STATES PATENT OFFICE
CERTIFICATE OF CORRECTION

Patent No. 4,023,882 Dated May 17, 1977

Inventor(s) Börge Hugo Pettersson

It is certified that error appears in the above-identified patent and that said Letters Patent are hereby corrected as shown below:

| | |
|---|---|
| Col. 2: | Line 7, "of" should be "or" |
| Col. 3: | Line 38, "ad" should be "and" |
| Col. 4: | Line 50, "thaat" should be "that" |
| Col. 6: | Line 5, "sutable" should be "suitable" |
| Col. 8: | Line 67 (claim 4) "than" should be "that" |
| Col. 9: | Lines 35-36 (claim 5) "connecting" should be "conducting" |
| Col. 11: | Line 23, "outward" should be "outwardly" |

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademark*